US006044499A

United States Patent [19]

Henson

[11] Patent Number: 6,044,499

[45] Date of Patent: Apr. 4, 2000

[54] PORTABLE ADJUSTABLE TOILET SEAT

[76] Inventor: Dana L. Henson, 2934 W. Royal La., #2133, Irving, Tex. 75063

[21] Appl. No.: 09/259,108

[22] Filed: Feb. 26, 1999

[51] Int. Cl.[7] ..... A47K 13/00

[52] U.S. Cl. ..... 4/237; 4/239; 4/244

[58] Field of Search ..... 4/234, 235, 237, 4/239, 254

[56] References Cited

U.S. PATENT DOCUMENTS

| | | | |
|---|---|---|---|
| D. 345,414 | 3/1994 | Douglas | D23/296 |
| 396,803 | 1/1889 | Breher | 4/239 |
| 1,438,491 | 12/1922 | Hilpert | 4/239 |
| 1,958,276 | 5/1934 | McCandless | 4/239 |
| 2,203,076 | 6/1940 | Baxter | 155/31 |
| 2,382,953 | 8/1945 | Baxter | 155/152 |
| 3,371,356 | 3/1968 | Benjamin | 4/239 |
| 4,525,880 | 7/1985 | Bass | 4/244 |
| 4,578,829 | 4/1986 | Lenosky | 4/237 |
| 5,090,063 | 2/1992 | Edwards et al. | 4/239 |
| 5,267,355 | 12/1993 | Landman | 4/239 |
| 5,524,295 | 6/1996 | Ford | 4/239 |
| 5,787,514 | 8/1998 | Erli | 4/239 |
| 5,809,584 | 9/1998 | Potts | 4/254 |

FOREIGN PATENT DOCUMENTS

| | | | |
|---|---|---|---|
| 23969 | 11/1911 | United Kingdom | 4/239 |

*Primary Examiner*—Steven O. Douglas
*Assistant Examiner*—Khoa Huynh
*Attorney, Agent, or Firm*—Smith & Danamraj, P.C.

[57] ABSTRACT

A portable toilet seat for use upon a conventional toilet seat. The portable toilet seat includes a front section and a rear section. The front section and rear section are connected to a plurality of side members which allows forward and aft movement of the rear section to accommodate usage by different sized people. In addition, the side members are connected to the rear section by a plurality of hinges which allows rotation of the rear section towards the front section, thereby reducing the size of the portable toilet seat and allowing easy transportation of the portable toilet seat. The portable toilet seat also includes a plurality of clamps for affixing the portable toilet seat to the conventional toilet seat.

11 Claims, 3 Drawing Sheets

PORTABLE ADJUSTABLE TOILET SEAT

BACKGROUND OF THE INVENTION

1. Technical Field of the Invention

This invention relates to toilet seats, and more particularly, to a portable toilet seat which fits over a public toilet.

2. Description of Related Art

Public toilets provide an essential function for people outside their homes. However finding a clean public toilet is difficult. Even when a restroom appears to be clean, people are apprehensive about using a public facility. Even with this apprehension, people must still use public toilets. When a person sits upon a public toilet, the person may be exposed to a wide variety of diseases and bacteria. In many cases, the toilet seat is so dirty, that for all practical purposes, the toilet is unusable. The problems of using a public toilet seat are particularly acute for children. Parents are apprehensive in allowing young children to use public toilets because children may be more susceptible to germs that are encountered on the public toilet. In addition, many small children cannot properly sit upon a public toilet seat because the toilet seat may be too large to accommodate the small body of the child. A device is needed which protects a user from directly contacting a public toilet seat while being adjustable to accommodate users of various sizes. The device should be easy to carry for use by people when traveling.

Although there are no known prior art teachings of a solution to the aforementioned deficiency and shortcoming such as that disclosed herein, prior art references that discuss subject matter that bears some relation to matters discussed herein are U.S. Pat. No. Des. 345,414 to Douglas (Douglas), U.S. Pat. No. 1,958,276 to McCandless (McCandless), U.S. Pat. No. 3,371,356 to Benjamin (Benjamin), and U.S. Pat. No. 5,090,063 to Edwards et al. (Edwards).

Douglas discloses a portable toilet seat for use by a child. The toilet seat includes a seat, a plurality of clamps for attachment on a conventional toilet seat, a seat back, and a plurality of pins for adjusting the width of the clamps. However, Douglas does not teach or suggest a means for adjusting the size of the portable toilet seat to accommodate different sizes of people. Additionally, Douglas does not disclose a toilet seat which is easy to transport.

McCandless discloses a toilet seat which may be readily mounted to a conventional toilet seat. The toilet seat includes a collapsible back and arms. The toilet seat also includes a clamping device for securing the toilet seat to a conventional toilet seat. Although McCandless discloses a foldable child's toilet seat, McCandless does not teach or suggest providing a means for easily transporting the toilet seat. McCandless merely discloses collapsing a back and arms attached to the toilet seat into a smaller area. Additionally, McCandless does not teach or suggest a means for adjusting the size of the portable toilet seat to accommodate different sizes of people.

Benjamin discloses a foldable child's toilet seat assembly. The assembly includes a child's toilet seat having clamps for affixing the child's toilet seat to a conventional toilet seat. In addition, the child's toilet seat includes a retractable cover. The toilet seat assembly may be collapsed into a smaller area for storage, however, Benjamin does not teach or suggest folding the actual toilet seat into a smaller area for easy transportation. Benjamin merely discloses folding peripheral devices attached to the toilet seat into a smaller and more convenient area. In addition, Benjamin does not discloses a means for adjusting the size of the portable toilet to accommodate various sizes of people.

Edwards discloses a portable toilet seat for use in public rest rooms. The toilet seat is foldable for compact storage in a carrier. The toilet seat is equipped with a roll of toilet paper and a pocket for personal hygiene items. The carrier may remain open and hung from the door of a rest room stall for easy accessibility by the user after the seat is removed and unfolded for use. Edwards does not teach or suggest adjusting the size of the portable toilet seat for accommodating various sizes of users. In addition, Edwards does not secure the portable toilet seat to a conventional toilet seat, rather the portable toilet seat is positioned on top of the conventional toilet without any clamps.

Review of each of the foregoing references reveals no disclosure or suggestion of an apparatus as that described and claimed herein. Thus, it would be a distinct advantage to have an apparatus which protects a user from the germs associated with a public toilet, and is adjustable and portable. It is an object of the present invention to provide such an apparatus.

SUMMARY OF THE INVENTION

In one aspect, the present invention is a portable toilet seat for use upon a conventional toilet seat. The portable toilet seat includes a seat structure for supporting a user sitting upon the portable toilet seat. In addition, the portable toilet seat includes means for adjusting the size of the seat structure to accommodate various sizes of users and means for affixing the seat structure to the conventional toilet seat. The portable toilet seat also includes means for collapsing the seat structure into a smaller area for easy transportation of the portable toilet seat.

In another aspect, the present invention is a portable toilet seat for use upon a conventional toilet seat. The portable toilet seat includes a front section for supporting a front portion of a user's body, a plurality of side members, a rear section for supporting a rear portion of the user's body, and means for adjusting the size of the portable toilet seat to accommodate users of varying sizes. In addition, the portable toilet seat includes means for attaching the rear section and the front section to the conventional toilet seat, a plurality of hinges linking the rear section to a first end of the side members, and a plurality of hinges linking the front section to a second end of the side members. The plurality of hinges allow the rotation of the rear section and front section in relation to the side members.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

A portable toilet seat which adjustably fits upon a public toilet is disclosed. The portable toilet seat accommodates people of different sizes.

Figure 1:
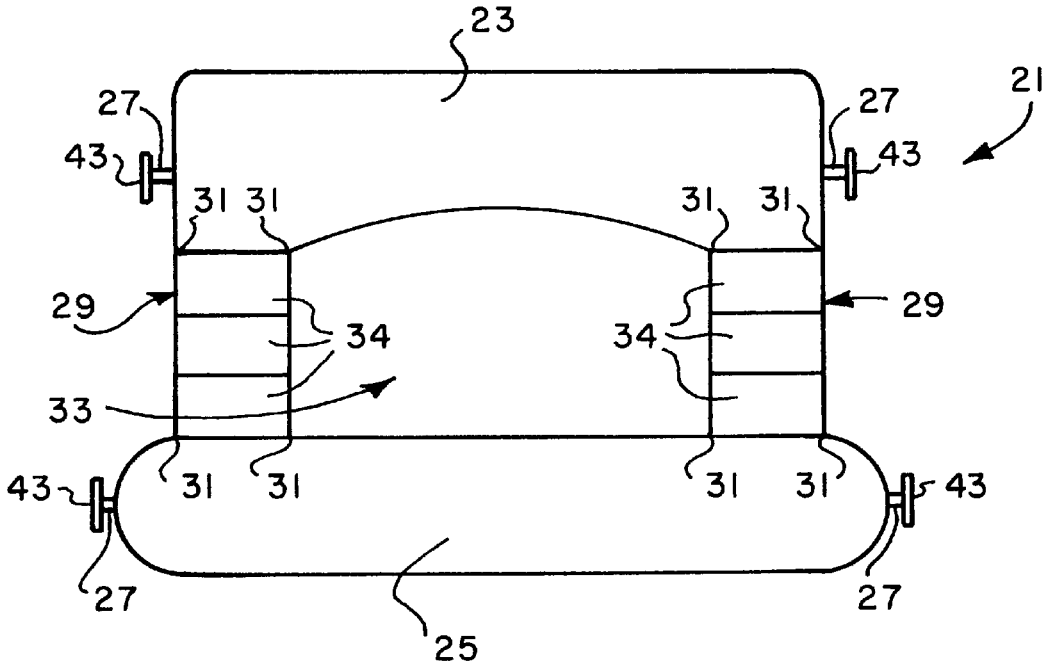
FIG. 1 is a top view of a portable toilet seat in a fully open configuration in the preferred embodiment of the present invention.

FIG. 1 is a top view of a portable toilet seat 21 in a fully open configuration in the preferred embodiment of the present invention. The portable toilet seat includes a rear section 23, a front section 25, two adjusting rods 27, two side members 29, and eight hinges 31.

In the preferred embodiment, the rear section 23 is contoured to provide maximum comfort and support to a user's buttocks, which rest upon the rear section during use of the portable toilet seat 21. The front section 25 is shaped to comfortably support the legs of the user. The rear section and front section are connected by the side members 29, which are located on each side of the rear section and the front section. The rear section, the front section, and the side members form an opening 33. Each side member is connected to the rear section by rotatable hinges 31. In addition, each side member is connected to the front section by rotatable hinges. The rear section, the front section, and the side members may be constructed of any durable material. However, in the preferred embodiment, the portable toilet seat is constructed of hard plastic.

Figure 2:
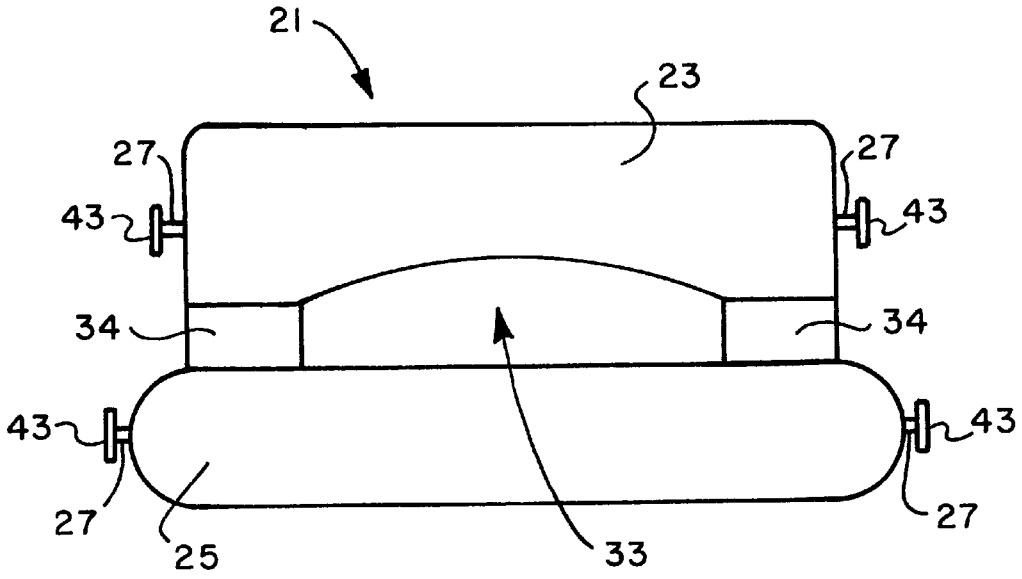
FIG. 2 is a top view of the portable toilet seat in a closed configuration in the preferred embodiment of the present invention.

FIG. 2 is a top view of the portable toilet seat 21 in a closed configuration in the preferred embodiment of the present invention. In an important feature of the portable toilet seat, the portable toilet seat may be adjusted to accommodate people of various sizes. The rear section 23 may be slid forward towards the front section 25, thereby decreasing the size of the opening 33 and effectively reducing the perimeter of the seating surface of the portable toilet seat. Each side member includes a plurality of slidable segments 34 (FIGS. 1 and 2). When sliding the rear section forward, each segment slides under an adjacent segment, thereby contracting the side member. By contracting the side members, the perimeter of the portable toilet seat is reduced, allowing the accommodation of small children. The rear section is slid rearward when larger users must be accommodated. When the rear section is slid rearward, the segments of the side members are slid out from adjacent segments telescopically.

Figure 3:
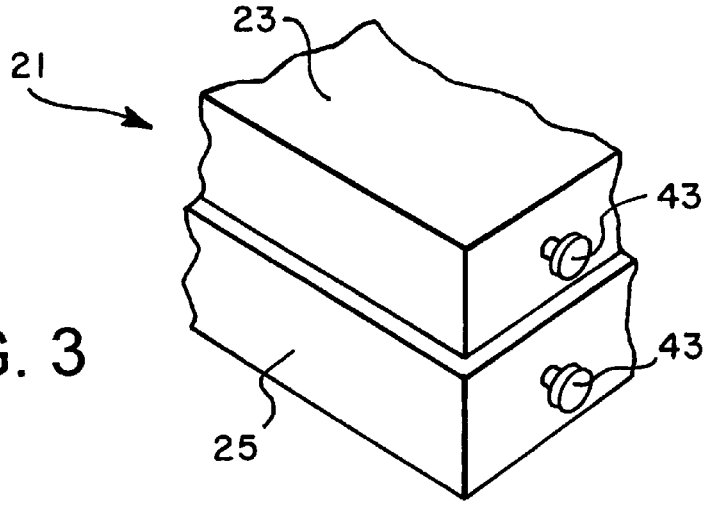
FIG. 3 is a top perspective view of the portable toilet seat in a collapsed configuration according to the teachings of the present invention.

FIG. 3 is a top perspective view of the portable toilet seat 21 in a collapsed configuration according to the teachings of the present invention. To provide ease in transporting the portable toilet seat, the portable toilet seat can be collapsed into a relatively small area. The hinges 31 (FIG. 1) allow the downward rotation of the rear section 23 and the front section 25 towards each other in clamshell fashion, which reduces the total size of the portable toilet seat. The portable toilet seat should be in the fully closed position, as shown in FIG. 2, to collapse the portable toilet seat into the smallest volume possible. The rear section and front section are then rotated downwardly towards each other. The fully collapsed portable toilet seat can then be easily placed in a carrying bag for transport. In alternate embodiments, the hinges 31 may be any number of hinges in any location necessary to allow the rotation of the front and rear sections towards each other in clamshell fashion.

Figure 4:
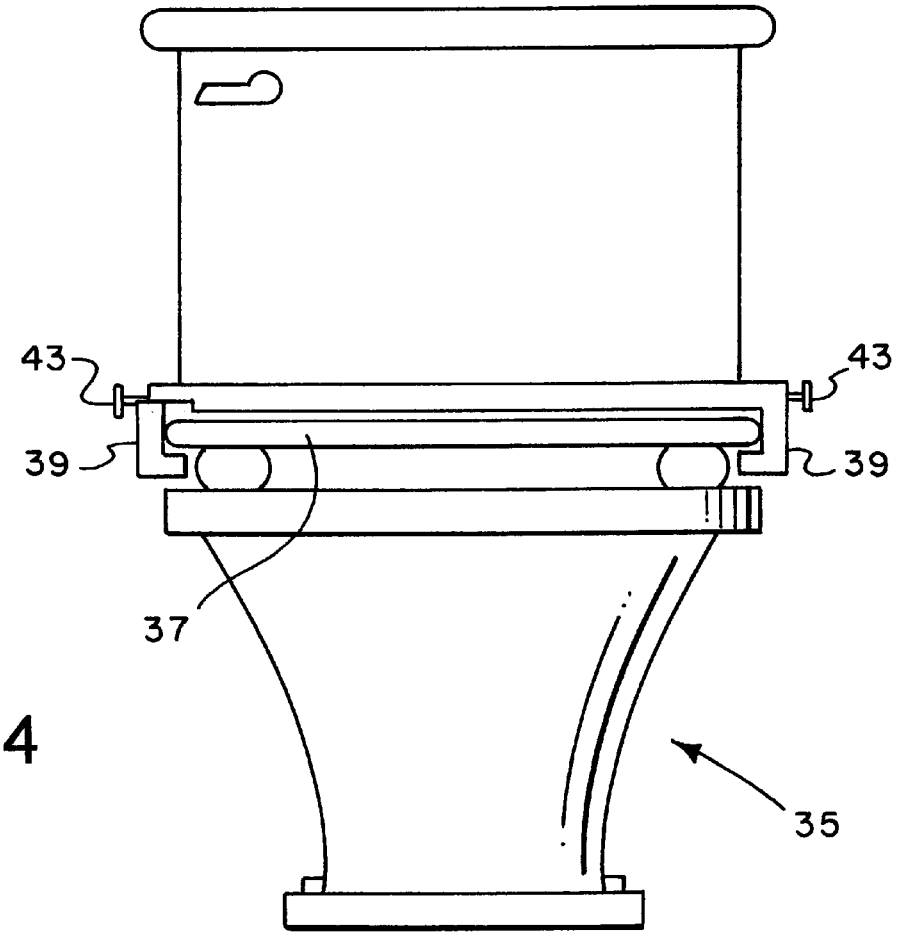
FIG. 4 is a front view illustrating the portable toilet seat attached to a conventional toilet according to the teachings of the present invention.

FIG. 4 is a front view illustrating the portable toilet seat 21 attached to a conventional toilet 35 according to the teachings of the present invention. The conventional toilet includes a conventional toilet seat 37. When the portable toilet seat is being used, the portable toilet seat attaches to the conventional toilet seat by four clamps 39, one on each side of the front section, and one on each side of the rear section. When in use, the clamps slide under the conventional toilet seat and hold the portable toilet seat securely in place. Although clamps are depicted in FIG. 4, other fastening devices may also be used, such as retaining members or elastic straps. Additionally, although four clamps are shown, any number of fastening devices may be utilized to affix the portable toilet seat to the conventional toilet seat.

Figure 5:
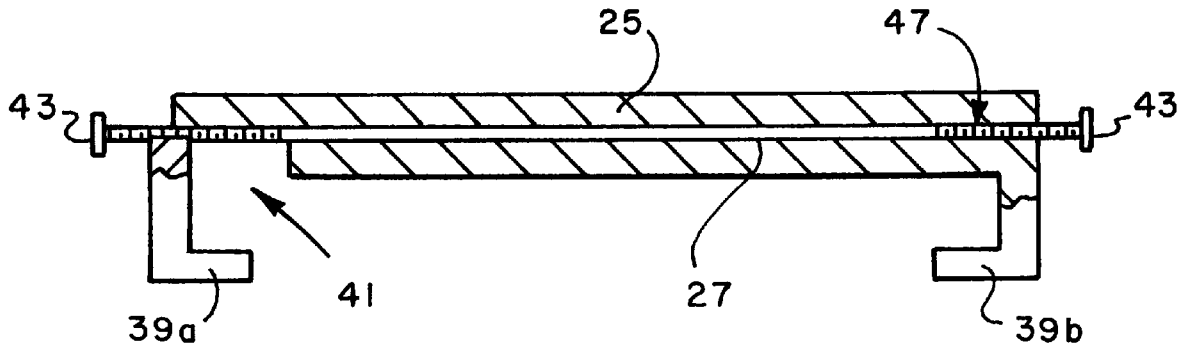
FIG. 5 is an enlarged front view of two of the clamps and one of the adjusting rods of the portable toilet seat according to the teachings of the present invention.

FIG. 5 is an enlarged front view of two of the clamps 39 and one of the adjusting rods 27 of the portable toilet seat 21 according to the teachings of the present invention. An adjusting rod 27 is integrated into both the front section 25 and the rear section 23. FIG. 5 illustrates the adjusting rod for the front section, but the adjusting rod for the rear section is similarly constructed. The left clamp 39*a* is attached to one end of the adjusting rod. The right clamp 39*b* is connected directly to the front or rear section. Located near one side of the adjusting rod (left side in FIG. 5) is a cut-away section 41 which allows the clamp 39*a* to slide laterally to accommodate various widths of different conventional toilet seats. Attached to each end of the adjusting rod 27 is an adjusting knob 43, for sliding the adjusting rod laterally. In one embodiment, the adjusting rod moves the clamp 39*a* by utilizing a locking assembly 45.

Figure 6:
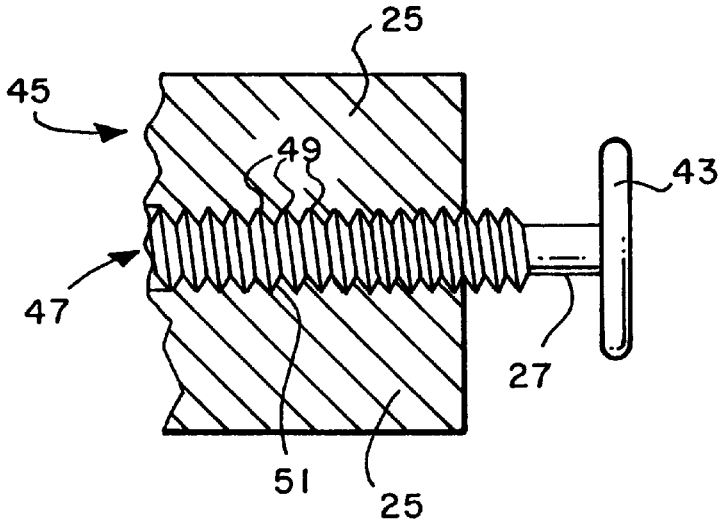
FIG. 6 is a enlarged front view of a screw assembly for adjusting the clamps of the portable toilet seat according to the teachings of the present invention.

FIG. 6 is a enlarged front view of the locking assembly 45 for adjusting the clamps 39 of the portable toilet seat 21 according to the teachings of the present invention. In the preferred embodiment of the present invention, the locking assembly 45 is employed to vary the distance between the clamp 39*a* and clamp 39*b*. The locking assembly includes a bore 47 running laterally through the interior of both the front and rear sections. The front section 25 is illustrated in FIG. 6. The bore includes a series of laterally spaced channels 49. Laterally spaced teeth 51 are positioned along the length of the adjusting rod 27. The teeth are located on only one side and fit within the channels. When the teeth are engaged within the channels, the adjusting rod is laterally locked in place. When the distance between the clamp 39*a* and clamp 39*b* needs to be adjusted, the adjusting knob 43 attached to the adjusting rod is twisted, thereby disengaging the teeth from the channels. The adjusting rod is then free to move laterally. Once the desired distance between clamp 39*a* and clamp 39*b* is obtained, the adjusting knob is twisted in an opposite direction, to lock the adjusting rod in place. Although the locking assembly 45 is illustrated, any device which allows the clamps 39 to be adjusted to accommodate the varying widths of conventional toilet seats may be utilized.

Referring to FIGS. 1–6, the operation of the portable toilet seat 21 will now be explained. The portable toilet seat 21 is configured in the fully collapsed position depicted in FIG. 3 when being transported, thereby providing for ease of transport and storage. When a user requires the use of a public toilet, the portable toilet seat is opened utilizing the hinges from the configuration of FIG. 3 to the configuration of FIG. 1. The portable toilet seat may be adjusted (front-to-back) to fit the size of the user. For example, if a small child is using the portable toilet seat, the seat is adjusted by sliding the rear section 23 forward towards the front section 25, which slides each segment 34 under an adjacent segment. By sliding the rear section forward, the perimeter of the portable toilet seat is reduced, thereby accommodating the small child. If a larger person is using the portable toilet seat, the rear section is slid rearward, away from the front section, which extends the segments telescopically, thereby increasing the length of the side members and increasing the perimeter of the portable toilet seat.

The portable toilet seat 21 is then positioned upon the conventional toilet seat 37. The right clamps 39*b* for both the rear section 23 and the forward section 25 are slid under the rim of the right side of the conventional toilet seat. The adjusting rods 27 for both the forward section and the rear section are moved by unlocking the locking assembly 45. This is accomplished by twisting the adjusting knobs 43 to disengage the teeth 51 from the channels 49. The adjusting rod is then free to move laterally allowing the distance between the right clamps 39*b* and the left clamps 39*a* to increase. When the left clamps 39*a* are wide enough to slide under the left side of the conventional toilet seat, the left clamps 39*a* are positioned under the rim of the left side of the conventional toilet seat. The distance between the left clamp 39*a* and the right clamp 39*b* is then decreased a sufficient amount to secure the portable toilet seat to the conventional toilet seat. The adjusting rods are then laterally locked in place by twisting the adjusting knobs in the opposite direction, which engages the teeth within the channels of the locking assembly. The attachment of the portable toilet seat is accomplished without any physical contact with the conventional toilet seat, reducing the likelihood of encountering any germs or bacteria present on the conventional toilet seat. The user of the portable toilet seat can then sit upon the portable toilet seat without touching the conventional toilet seat.

When the user of the portable toilet seat 21 is finished, the portable toilet seat 21 is removed from the conventional toilet seat 37. The adjusting rods 27 are unlocked by twisting the adjusting knobs 43, which disengages the teeth from the channels of the locking assembly, allowing the free movement of the adjusting rod. The adjusting rod is then adjusted to increase the width between the clamps 39*a* and clamps 39*b*. The portable toilet seat is then removed from the conventional toilet seat. Prior to collapsing the toilet seat, the portable toilet seat should be closed into the configuration depicted in FIG. 2. The rear section and the front section are then collapsed in clamshell fashion by rotating the front and rear sections downwardly towards each other. The rotation of the front and rear sections is accomplished by bending the portable toilet seat at the hinges 31 located at the junction between the side members and the front and rear sections. The fully collapsed portable toilet seat (FIG. 3) can then be placed within a carrying case, allowing easy and discreet transportation of the portable toilet seat.

The portable toilet seat 21 offers many advantages over existing toilet seats. The portable toilet seat provides a clean toilet seat to a user. The portable toilet seat can be easily and securely attached to conventional toilet seats of varying sizes without touching the toilet seat. The clamps provide a simple means of securing the portable toilet seat to the conventional toilet seat 37. The portable toilet seat can also accommodate different sizes of people, ranging from a large adult to a small child. The portable toilet seat is especially helpful to a parent traveling with a child, by performing the dual function of avoiding unwanted contact with a public toilet seat while providing the small child with a toilet seat which the child can use with comfort and ease. In addition, reducing the size of the toilet seat allows easy transportation and storage.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A portable toilet seat for use upon a conventional toilet seat, the portable toilet seat comprising:

a seat structure for supporting a user sitting upon the portable toilet seat, the seat structure comprising a front section, a rear section, and a plurality of side members connecting the front and rear sections;

means for adjusting the size of the seat structure to accommodate various sizes of users, said adjusting means including means for sliding the rear section forward and aft in relation to the front section, thereby adjusting the size of the seat structure; and means for affixing the seat structure to the conventional toilet seat.

2. A portable toilet seat for use upon a conventional toilet seat, the portable toilet seat comprising:

a seat structure for supporting a user sitting upon the portable toilet seat, the seat structure having:

a front section;

a rear section; and a plurality of side members connecting the front and rear sections, the plurality of side members including a plurality of slidably connected segments for telescopically extending and retracting the plurality of side members;

means for adjusting the size of the seat structure to accommodate various sizes of users; and means for affixing the seat structure to the conventional toilet seat.

3. The portable toilet seat of claim 1 wherein the means for affixing the seat structure to the conventional toilet seat includes a plurality of clamps for grasping an underside of the conventional toilet seat.

4. The portable toilet seat of claim 3 further comprising means for adjusting the plurality of clamps to accommodate various widths of a conventional toilet seat.

5. The portable toilet seat of claim 4 wherein the means for adjusting the plurality of clamps includes a plurality of adjusting rods for adjusting the plurality of clamps to accommodate various widths of the conventional toilet seat.

6. The portable toilet seat of claim 1 further comprising a plurality of hinges for folding the front section towards the rear section and the rear section towards the front section, thereby collapsing the seat structure into a smaller volume for transport.

7. A portable toilet seat for use upon a conventional toilet seat, the portable toilet seat comprising:

a front section for supporting a front portion of a user's body;

a plurality of side members connecting the front section and the rear section;

a rear section for supporting a rear portion of the user's body;

means for adjusting the size of the portable toilet seat to accommodate various sizes of different users;

means for attaching the rear section and the front section to the conventional toilet seat;

a plurality of hinges linking the rear section to a first end of the side members, the plurality of hinges allowing rotation of the rear section in relation to the side members; and a plurality of hinges linking the front section to a second end of the side members, the plurality of hinges allowing rotation of the front section in relation to the side members.

8. The portable toilet seat of claim 7 wherein the means for attaching the rear section and the front section to the conventional toilet seat includes a plurality of clamps for grasping an underside of the conventional toilet seat.

9. The portable toilet seat of claim 8 further comprising means for laterally adjusting the plurality of clamps to accommodate various sizes of the conventional toilet seat.

10. The portable toilet seat of claim 9 wherein the means for laterally adjusting the plurality of clamps includes a plurality of adjusting rods to vary the distance between each of the clamps.

11. The portable toilet seat of claim 7 wherein the means for adjusting the size of the portable toilet seat to accommodate various sizes of different users includes the side members having slidable segments for extending and retracting the side members to allow the rear section to slide forward and aft in relation to the front section.

* * * * *